US009668558B2

(12) United States Patent
Clamp et al.

(10) Patent No.: US 9,668,558 B2
(45) **Date of Patent: *Jun. 6, 2017**

(54) CONTACT LENS PACKAGING

(71) Applicant: Contact Lens Precision Laboratories Ltd., Bedfordshire (GB)

(72) Inventors: John Clamp, Bedfordshire (GB); Richard Newell, Bedfordshire (GB)

(73) Assignee: CONTACT LENS PRECISION LABORATORIES LTD., Bedfordshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/867,738

(22) Filed: Sep. 28, 2015

(65) Prior Publication Data

US 2016/0015139 A1 Jan. 21, 2016

Related U.S. Application Data

(63) Continuation of application No. 14/088,893, filed on Nov. 25, 2013, now Pat. No. 9,173,463.

(51) Int. Cl.

| | |
|---|---|
| ***H01L 23/02*** | (2006.01) |
| ***A45C 11/00*** | (2006.01) |
| ***B65B 25/00*** | (2006.01) |
| ***B65B 17/02*** | (2006.01) |
| ***B65B 55/08*** | (2006.01) |
| ***B65B 55/22*** | (2006.01) |
| ***B65D 43/02*** | (2006.01) |
| ***B65D 71/50*** | (2006.01) |
| ***B65D 81/22*** | (2006.01) |
| ***B65D 83/08*** | (2006.01) |

(Continued)

(52) U.S. Cl.

CPC ..... *A45C 11/005* (2013.01); *B65B 17/02* (2013.01); *B65B 25/008* (2013.01); *B65B 55/08* (2013.01); *B65B 55/16* (2013.01); *B65B 55/22* (2013.01); *B65D 21/0204* (2013.01); *B65D 21/0227* (2013.01); *B65D 21/0228* (2013.01); *B65D 43/02* (2013.01); *B65D 71/50* (2013.01); *B65D 81/22* (2013.01); *B65D 83/0409* (2013.01); *B65D 83/0805* (2013.01); *B65D 83/0817* (2013.01); *A45C 2011/006* (2013.01); *B65D 2585/545* (2013.01)

(58) Field of Classification Search

CPC ..... B65B 25/008; A45C 11/005; H01L 2224/05291

See application file for complete search history.

(56) References Cited

U.S. PATENT DOCUMENTS

| | | | |
|---|---|---|---|
| 4,775,076 | A | 10/1988 | Horvath |
| 5,618,492 | A | 4/1997 | Auten et al. |

(Continued)

FOREIGN PATENT DOCUMENTS

| | | | |
|---|---|---|---|
| WO | 0106970 | A1 | 2/2001 |
| WO | 2013098870 | A1 | 7/2013 |
| WO | 2013136361 | A1 | 9/2013 |

*Primary Examiner* — Elias M Ullah

(74) *Attorney, Agent, or Firm* — Dentons US LLP

(57) ABSTRACT

Disclosed is a stack of individually separable packages for a plurality of contact lenses, each individual lens being packaged between a first surface and a second surface, wherein the first surface is provided by a first one of the individually separable packages and the second surface is provided by a second one of the individually separable packages.

13 Claims, 14 Drawing Sheets

(51) Int. Cl.

| | |
|---|---|
| ***B65D 21/02*** | (2006.01) |
| ***B65B 55/16*** | (2006.01) |
| ***B65D 83/04*** | (2006.01) |

(56) References Cited

U.S. PATENT DOCUMENTS

| | | | | |
|---|---|---|---|---|
| 6,474,465 | B1 | 11/2002 | Jux | |
| 9,173,463 | B2 * | 11/2015 | Clamp ..... | A45C 11/005 |
| 2002/0063068 | A1 | 5/2002 | Faxe et al. | |
| 2002/0158477 | A1 | 10/2002 | Faxe et al. | |
| 2002/0175177 | A1 | 11/2002 | Jepson | |
| 2006/0219577 | A1 | 10/2006 | Newman | |
| 2007/0296096 | A1 | 12/2007 | Bruce et al. | |
| 2011/0089584 | A1 | 4/2011 | Plaza et al. | |
| 2012/0218509 | A1 | 8/2012 | Back et al. | |

* cited by examiner

SECTION
XX-XX

CONTACT LENS PACKAGING

This application is continuation application of U.S. patent application No. 14/088,893, filed on Nov. 25, 2013, which claims priority to Great Britain Patent Application No. GB 1320153.8, filed Nov. 14, 2013, both of which are incorporated by reference in their entirety for all purposes as if fully set forth herein.

FIELD OF THE INVENTION

The present invention relates to packaging for contact lenses, especially for silicone hydrogel contact lenses, and relates in particular to a plurality of separably joined individual packages, and to a method of making the same.

BACKGROUND OF THE INVENTION

It is well known to provide individual packaging for contact lenses. In particular, disposable contact lens for daily wear are often provided in horizontal strips of about 5 or 6 individual cases, each case containing a respective individual contact lens, with typically about 30 individual cases provided in a cardboard box (i.e. enough lenses for about 1 month for 1 eye).

Daily-wear disposable lenses are conventionally formed of silicone hydrogel materials, which must be kept hydrated and in curved form, so that they are immediately ready for use when removed from the packaging. Thus, for example, U.S. Pat. No. 6,260,695 discloses packaging for hydrogel contact lenses in a dehydrated state, such that the packaging disclosed therein is not useful for providing hydrogel contact lenses in a ready-to-wear form.

It is known also to provide packaging for contact lenses in which the lenses are stored flat, rather than in curved form (see e.g. US 2004/0238380). This is suitable for contact lenses formed of older style materials, but is not appropriate for contact lenses made using the latest silicone hydrogel materials, as it has been found that storing them in flattened form stretches them beyond their elastic limit, and when removed from the flattened packaging the lenses do not resume the desired curvature for optimum fit and/or optimum optical correction.

SUMMARY OF THE INVENTION

In a first aspect the invention provides a stack of individually separable packages for a plurality of contact lenses, each individual lens being packaged between a first surface and a second surface, wherein the first surface is provided by a first one of the individually separable packages and the second surface is provided by a second one of the individually separable packages.

Adjacent members of the stack of individually separable packages are joined, and more especially sealed together, by a separable connection, typically (but not necessarily) a layer of adhesive material. Adhesives suitable for use in the invention will be apparent to those skilled in the art and specific examples are detailed below.

In a preferred embodiment however adjacent members of the stack are joined by a mechanical fit which forms a seal between adjacent packages without the need for an adhesive. For example, adjacent packages may clip together via a snap fit closure. If desired, an intervening sealing member may be provided around concave and/or peripheral portions of the packages, such as a rubber or silicone gasket or O-ring, although such is preferably avoided.

In one embodiment at least part of each package is formed of a material with a degree of resilient deformability, which assists in the formation of a snap fit closure. Preferably the packages are shaped such that a protruding part or section of one package forms a snap fit closure or the like with a correspondingly shaped recess on an adjacent package in the stack. Conveniently there is a reciprocal fit between the adjacent packages. By a "reciprocal fit" it is intended that each package is provided with both male and female portions which co-operate with reciprocal female and male portions on an adjacent package.

In a preferred embodiment, the mechanical seal is formed in a tamper-evident manner. For example, a frangible portion may be provided on the packages which is broken or ruptured when joined packages are separated.

Desirably each of the individually separable packages is of generally similar design. A preferred design for the individually separable packages comprises: a cup-shaped concave portion which accommodates a contact lens in its naturally curved form, and a small amount of aqueous liquid (e.g. sterile saline solution) which is in contact with the contact lens and serves to keep it hydrated; and a peripheral portion which includes a flange which projects outwards from the concave cup-shaped portion and provides a surface by which a force can be applied (e.g. by one or more digits) to separate the individual package from the stack. The cup-shaped portion is preferably substantially a portion of a sphere (e.g. an inverted spherical cap or spherical dome), and the peripheral portion is, conveniently, generally circumferential to the cup-shaped portion. Optionally the peripheral portion may be formed with a downward projecting part, to form a flat base on which the stack of packages may rest.

Preferably, as will be apparent, the stack of individually separable packages accommodates a plurality of contact lenses, one contact lens in each respective package. The contact lens may be any type of contact lens including, for example, rigid gas permeable ("RGP") lenses and soft contact lenses, but the invention is especially useful for packaging disposable contact lenses which might be intended for disposal daily, weekly or on a monthly basis and, in particular, contact lenses formed from hydrogel materials of the sort familiar to the person skilled in the art, including silicone hydrogel ("SiH") and other materials.

As noted above, adjacent members of the stack are joined, typically by a small amount of adhesive and/or a mechanical sealing fit, such that each contact lens is sealed in a substantially air tight manner, together with a small amount of an aqueous liquid, between the adjacent members of the stack. The 'lid' to each of the plurality of individual packages is thus essentially formed by the base of an overlying package. The invention thus dispenses with the need for a separate lid, such as a peelable film or foil, to be placed over each package in order to seal the contact lens in place.

It will be apparent that the outer surface of an upper package should not contact the inner surface of a cup-shaped portion of a lower package, at least over a portion thereof, so as to form the necessary cavity within which the contact lens may be accommodated. This can be accomplished by, for example, providing a raised profile on the peripheral portion of the lower package, and/or providing a downward projecting part on the underside of the upper package, and/or by ensuring that the respective surfaces of the upper and lower packages are not congruent.

It will be apparent to those skilled in the art that the size of the cavity formed between adjacent packages in a stack can be varied by altering the profile or shape of the respective surfaces of the adjacent packages. In this way, the maximum volume of aqueous liquid, such as aqueous saline or other solution, which can be accommodated in the cavity along with the lens, can be adapted to the desired circumstances. Thus, for example, a small volume of aqueous liquid (and correspondingly small volume cavity) may be employed if it is preferred to reduce the likelihood of spillage or mess when a package is opened by removing it from the stack. Conversely, a larger cavity and larger volume of aqueous liquid may be used if it is considered desirable to provide sufficient liquid in the package to allow the lens to be rinsed before insertion.

In a preferred embodiment, a contact lens is introduced into the concave cup-shaped portion of a first package, before or after a small aliquot of a suitable aqueous liquid, a second package is overlaid the first, and optionally adhered thereto by a suitable adhesive, such that the adhesive (if any) and the first and second packages cooperate to define a small, substantially air-tight cavity containing the contact lens and the hydrating aqueous liquid. Alternatively the packages are sealed by being pressed into a mechanical sealing fit, such as a snap fit closure, typically without the use of an adhesive. A second contact lens, together with an aliquot of aqueous liquid, is then placed into the concave cup-shaped portion of the second package, and sealed by adhering a third package on top of the second package. The process can be repeated as often as desired, until a stack of packages, each package containing a respective individual contact lens, is formed. Once a stack of the desired number of packages (e.g. 30 or 60) has been formed, the stack and its contents are preferably sterilised, conveniently by autoclaving. Alternatively, the stack (and the contents thereof) may be sterilised during its formation by irradiation (preferably UV irradiation) of the individual packages/and lenses etc. as they are added to the stack.

In particular, the concave cup-shaped portion of an upper package may desirably be at least partially accommodated within the concave cup-shaped portion of a lower package. More preferably the concave cup-shaped portion of the upper package is substantially accommodated in this way (e.g. at least 30% of the volume of the cup-shaped portion of the upper package is accommodated within the cup-shaped portion of the package beneath, preferably at least 40%, more preferably at least 50%). In this way, only a very small amount of aqueous liquid is required to keep a packaged contact lens hydrated. More importantly, the 'dead' volume of the packaging is substantially reduced, leading to more efficient use of materials and significant reduction in cost of manufacture, storage and transport of the packages, whilst still packaging the contact lens in its desired curved form so that it is not deformed or flattened by the packaging.

In a preferred embodiment, the concave portion is a substantially circular section cup-shape, optionally with a raised annular shoulder or rim. In this preferred embodiment, the concave portion is formed with a peripheral portion along at least part of the cup portion which conveniently comprises a thin, outwardly projecting flange, which acts as a surface to which a suitable force can be applied (e.g. by a digit or by means of a thumbnail or fingernail) to separate the individual package from the stack of packages.

In some embodiments, the stack will be such that the endmost package (typically, the lowermost) of the stack is easier to separate from the stack than it is to break the stack at an internal location. More especially, the stack will preferably such that only the endmost (or lowermost) package can be readily separated from the stack. Conveniently this is accomplished by causing a mechanical 'locking' to occur when a package is no longer the endmost package. For example, attaching a new package to the bottom of a stack may lock in place the package above it in the stack, by imposing a mechanical constraint on the package. One way of achieving this is by forming the packages from a material which is resiliently deformable, or by providing the package with one or more portions formed of such material, such that the package newly added to the end of the stack grips onto the outer surface of the previous endmost package, forcing it against the package preceding the previous endmost package, and so on.

The packages in the stack may be essentially identical or they may for example possess a handedness. Conveniently a handedness may be imparted to the package by the position and/or shape of a flange portion. In one embodiment, a stack of packages may contain alternating left- and right-handed packages, in which the position and/or shape of a flange portion varies between the left and right handed packages. This alternating pattern creates a small gap between pairs of nearest left-handed packages and between pairs of nearest right-handed packages, to facilitate the insertion of a fingertip or fingernail etc. to separate a package from the stack.

Materials

The packages are conveniently formed wholly or substantially from a synthetic plastics material. Preferably the packages are formed by moulding. Suitable materials for the packages include polypropylene and derivatives thereof or polycarbonate and derivatives thereof. Polypropylene is cheap, suitable for injection moulding and able to be autoclaved. Polycarbonate is not so suitable as a material, as it can be a little brittle, but is compatible with a wider range of adhesives than polypropylene. Accordingly, polycarbonate is not preferred for those embodiments in which there is a snap-fit closure between adjacent packages.

Adhesive

As explained elsewhere use of an adhesive is not essential but, if used, for polypropylene packages a preferred adhesive would be a cyanoacrylate-based adhesive (e.g. Loctite® 406 or 4061). Pretreatment of the packages with a suitable primer (e.g. Loctite® 770 or 7701) may be desirable to allow the adhesive to coat the polypropylene surface of the packages. Preferred primer compositions include a substance which is fluorescent (e.g. especially under UV illumination), to facilitate visual inspection of the coverage of the primer. A cyanoacrylate adhesive provides good sealing properties, can withstand autoclaving (at a temperature of 121° C. for 15 minutes), yet is weak enough to allow easy separation and peeling apart of a package from the stack.

The uppermost contact-lens containing package of the stack can be covered and sealed either by a 'blank' package or, more preferably, by metallic or metallised foil conventionally used for contact lens packages (e.g. Steril Up® lidding available from Amcor).

In a preferred embodiment, a stack of packages in accordance with the invention may conveniently be supported in a holder or dispenser, adapted and configured to accommodate at least one stack of packages in accordance with the invention. The holder or dispenser is conveniently itself formed from a synthetic plastics material and may typically be formed by moulding, extrusion or 3D printing or the like. In one embodiment the holder or dispenser has a flat base, and a substantially vertical wall or channel-forming member projecting upwards from the base to define a cavity, channel or the like of appropriate shape and dimension to accommodate at least one stack of packages in accordance with the invention. In one embodiment the holder has a cavity or channel of suitable size and dimension to accommodate, side-by-side, two stacks of essentially identical contact lens packages. In such an embodiment, one stack may contain lenses prescribed for a consumer's left eye, and the other stack may contain lenses prescribed for the consumer's right eye. In this embodiment, the holder or dispenser may be marked with 'L' and 'R' or 'Left' and 'Right' or some other marking or indication to distinguish between the two stacks of packages held in the holder/dispenser.

The holder may be provided with one or more biasing means (such as a spring), which tends to urge the stack of packages out of the holder. The biasing means may be resisted by a restraining means. Conveniently the restraining means can be temporarily disabled by manual operation. The manual operation may comprise actuation of a button, lever or the like. Preferably this manual operation additionally (and desirably simultaneously) serves to separate an individual package from the stack, which separated package is then dispensed by the action of the biasing means. Releasing the button or lever typically reinstates the restraining means.

The shape of the vertical channel or groove is desirably adapted and configured to form a snug fit with the packages. The holder may also be provided with an optional lid which is slidably received within the same channel or groove which accommodates the stack of packages, the profile of the lid being suitably shaped and dimensioned. The holder can be used to hold the stack of contact lens packages upright e.g. on a shelf.

In a second aspect there is provided a method of making a stack comprising a plurality of individually separable contact lens packages, the method comprising the steps of:

(a) forming a plurality of empty individual contact lens packages;

(b) inserting a contact lens and an aliquot of suitable aqueous liquid in a cavity in a concave portion of a first package; and (c) sealing the contact lens and aqueous liquid in the cavity by positioning a second package on top of the first package and sealing the second package to the first, optionally by means of a suitable adhesive.

Typically steps (b) and (c) are repeated several times to form a stack with many (e.g. 30 or more) contact lens packages, each containing a contact lens and an aliquot of aqueous liquid. The uppermost contact lens-containing package in the stack may be sealed either by adhering a blank package to the top, or by sealing the package with a conventional lid of peelable metallic film. Desirably after the stack has been formed it is sterilised, preferably by autoclaving, or, in the alternative, it is sterilised during stack formation by UV irradiation.

In another aspect, the invention provides a stack of individually separable packages for a plurality of items, each item being packaged between a first surface and a second surface, wherein the first surface is provided by a first one of the individually separable packages and the second surface is provided by a second one of the individually separable packages.

The items packaged in the packages may be anything which is required to be packaged in sealed containers. Examples include pills, tablets, capsules, doses of powders, and non-medicinal products such as foodstuffs or the like.

The invention will now be further described by way of illustrative example and with reference to the following drawings, wherein.

Figure 8A:
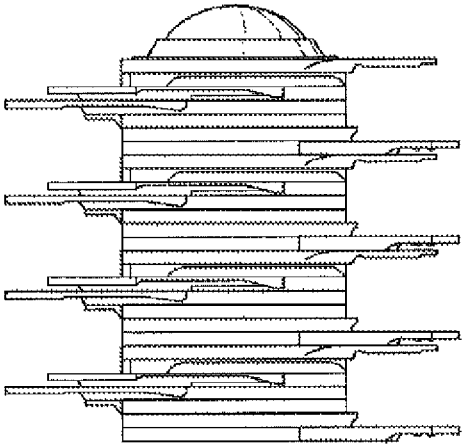
Figure 8B:
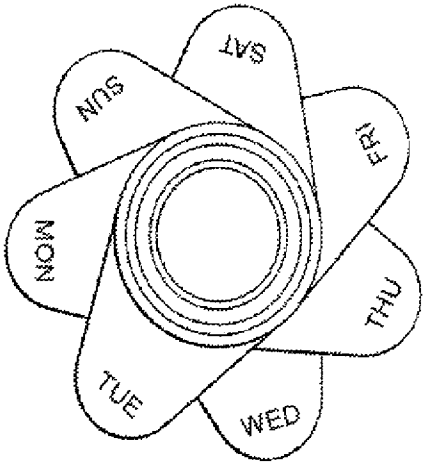
Figure 8C:
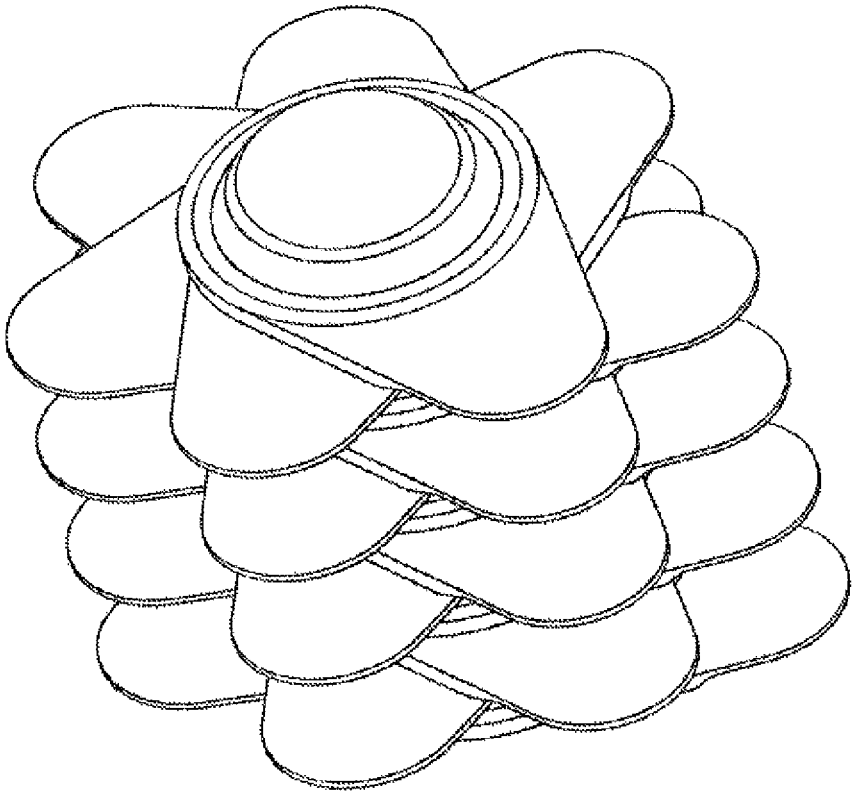
Figure 9:
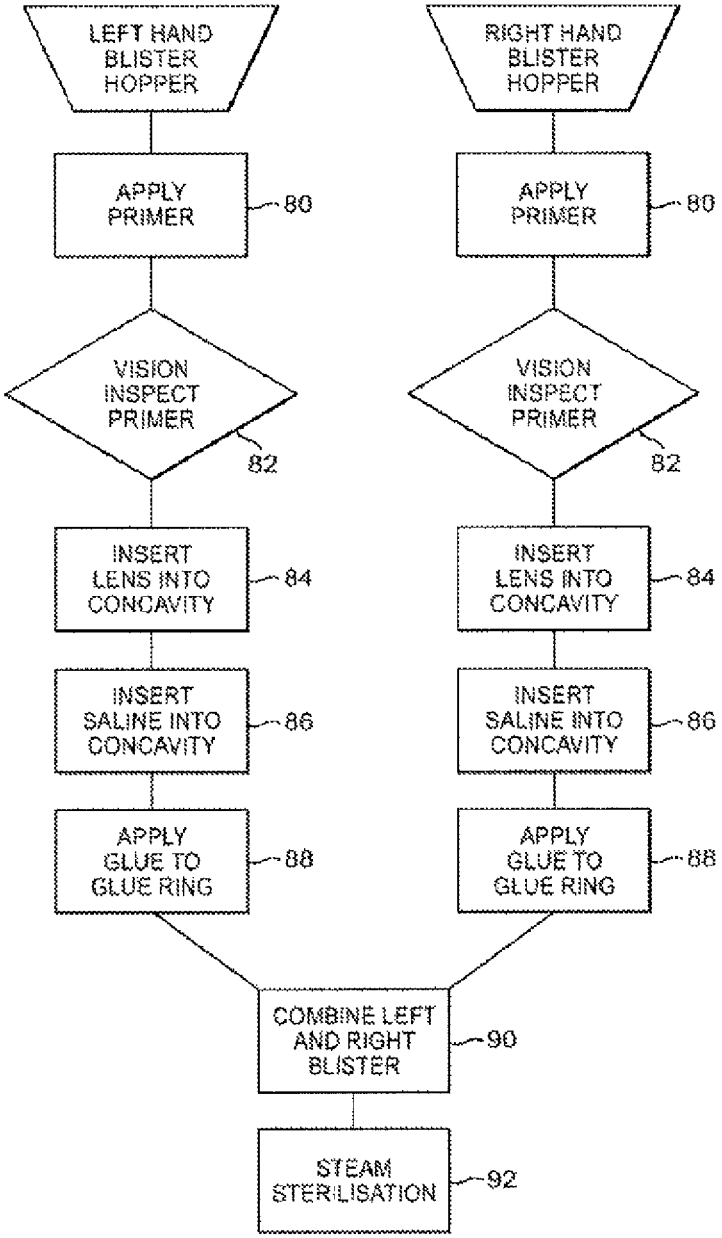
Figure 10:
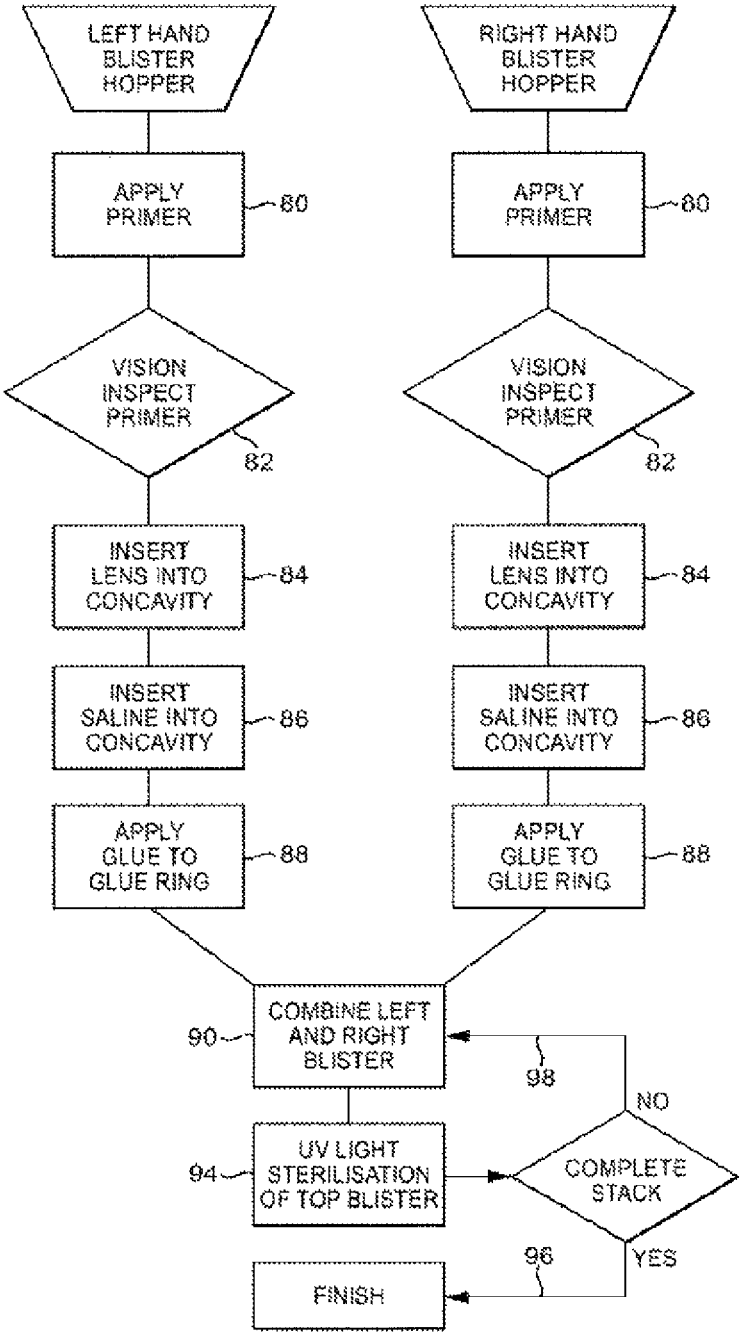
Figure 11A:
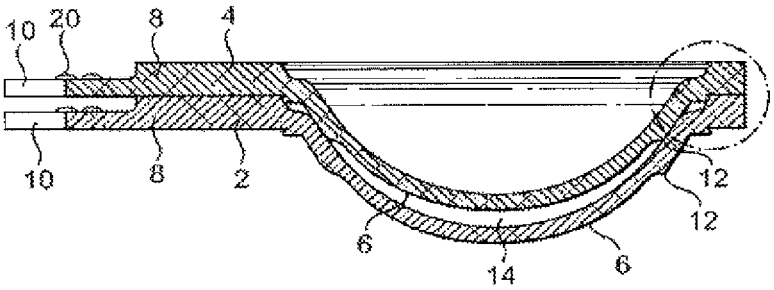
Figure 11B:
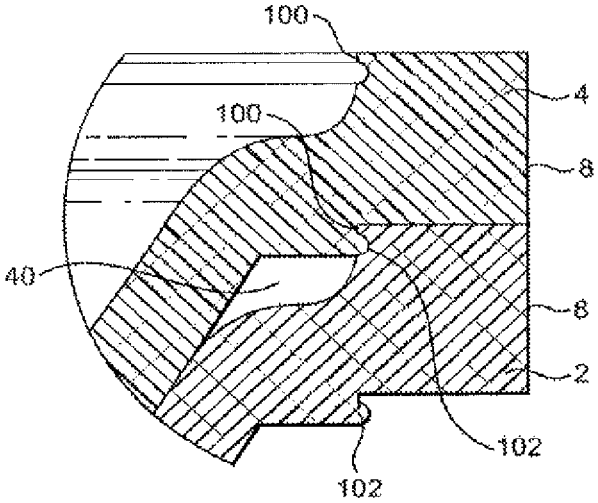
Figure 12:
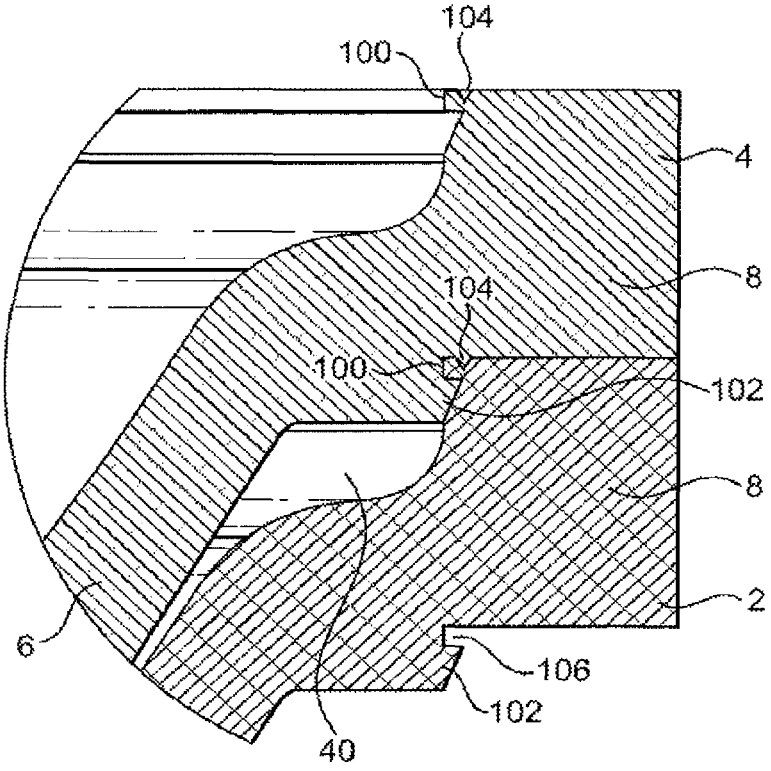
Figure 13A:
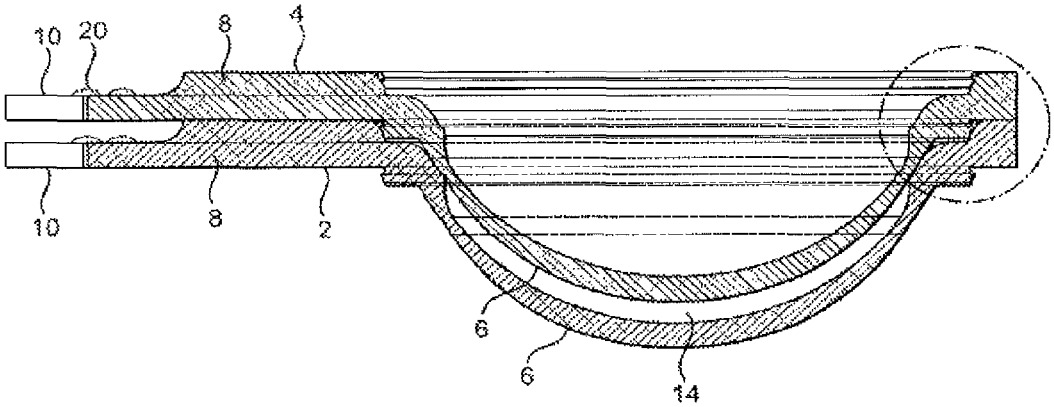
Figure 13B:
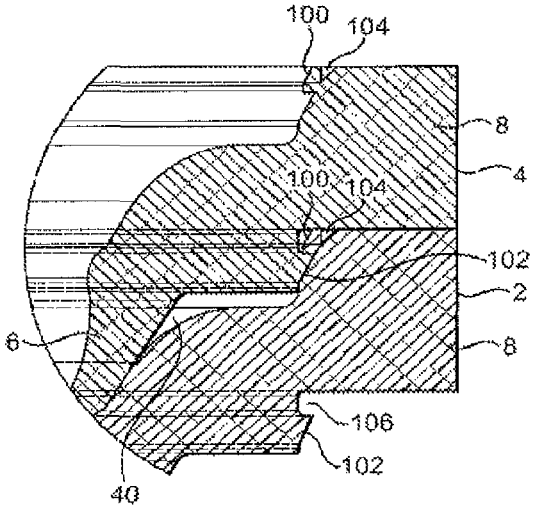

FIGS. 8A-8C are side, top plan and perspective views of another embodiment of a stack of individual contact lens packages in accordance with the invention; and FIGS. 9 & 10 are flow diagrams schematically illustrating embodiments of an automated method of making a stack of individual contact lens packages in accordance with the invention; and FIG. 11A is a sectional view of two packages according to a further embodiment, in which adjacent packages in a stack are sealed by a mechanical fit;

FIG. 11B is a detailed view of part of FIG. 11A, on a different scale;

FIG. 12 is a sectional view of part of a further embodiment, in which a tamper-evident mechanical seal is provided between adjacent packages; and FIGS. 13A & 13B are sectional views of two packages according to yet a further embodiment in accordance with the invention.

EXAMPLES

With reference to FIG. 1, one embodiment is shown of two individual contact lens packages suitable for use in a stack in accordance with the invention.

Figure 1A:
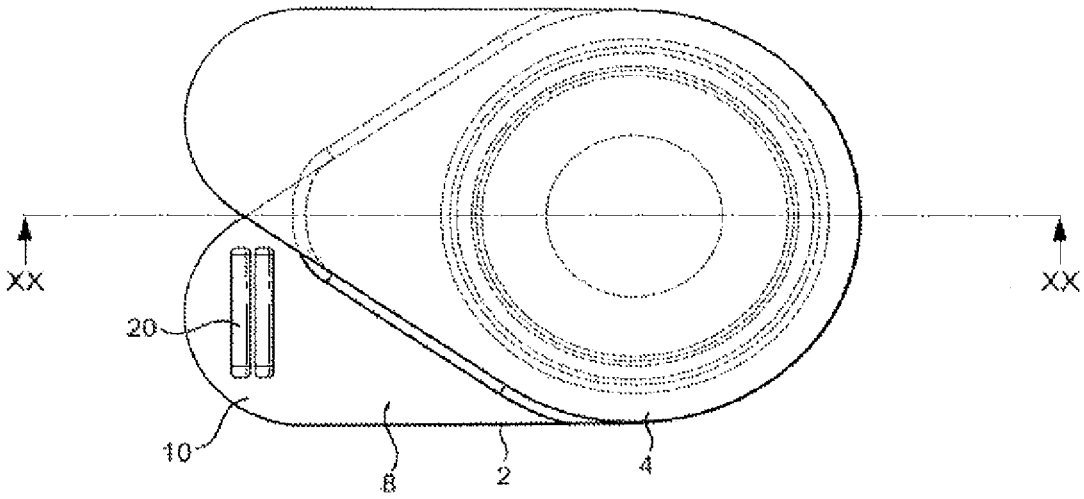
FIGS. 1A-1C are various views of two individual contact lens packages which may be used to form a stack of packages in accordance with the invention.
Figure 1B:
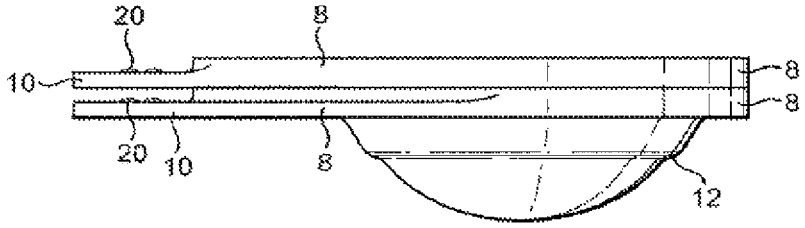

FIG. 1A is a plan view of the two packages, 2, 4. FIG. 1B shows a side elevation of the two packages, and FIG. 1C is a sectional view along the section xx-xx, indicated by a broken line in FIG. 1A.

The two packages 2, 4 are generally very similar in size and shape, except that package 2 has a right handedness and package 4 has a left handedness. Thus, for example, each package 2, 4 has essentially the same profile, as best seen in FIG. 1C, and each package is about 3.3 cm along its long axis and about 2.2 cm wide. The packages 2, 4 are both formed of a synthetic plastics material such as polypropylene or (less preferably) polycarbonate.

Each package comprises a concave cup-shaped portion 6 and a peripheral circumferential portion 8 which, along at least part of its length projects outwardly from the concave portion 6 in a thin flange 10. Package 4 is stacked on top of package 2, such that the concave cup-shaped portion 6 of the upper package 4 is largely received within the concave cup-shaped portion 6 of the lower package 2.

Figure 1C:
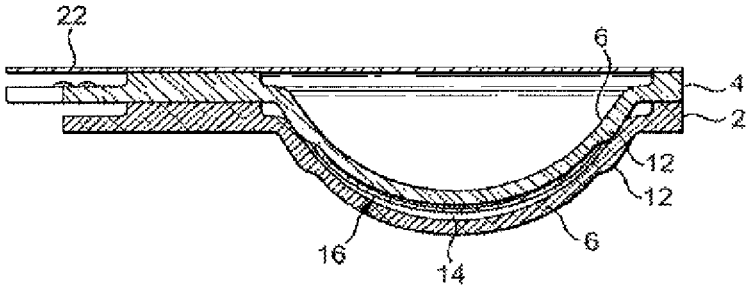

As best seen in FIGS. 1B & 1C, the convex outer surface of the concave cup shaped portion 6 has a profile with a shoulder or step 12 formed therein. The package 4 is positioned so that its concave cup-shaped portion 6 is substantially accommodated within the concave cup-shaped portion 6 of the package 2 beneath it. The shoulder or step 12 in the convex outer profile of the concave cup shaped portion 6 of package 4 ensures that the lower part of the concave portion of the upper package 4 does not fit flush with the concave profile of the lower package 2, thereby creating a small cavity between the two packages.

Within the cavity 14 so formed is accommodated a silicone hydrogel contact lens 16, together with a small volume of sterile aqueous liquid, such as saline solution. Thus the cavity 14 is defined by two surfaces, one being the upper surface of the cup-shaped portion 6 of the lower package 2, and the other being the lower (convex) surface of the cup-shaped portion 6 of the upper package.

The upper package 4 is adhered to the lower package 2 by a small amount of suitable adhesive, applied to the peripheral portions 8 of the two packages, as explained in greater detail below. The adhesive creates a substantially air tight seal between the two packages so that, once the packages and the contact lens contained therein have been sterilised (e.g. by autoclaving or UV irradiation), the contact lens can remain sterile for prolonged periods (e.g. well over 12 months).

The flange portion 10 of each package is formed with grip feature 20 which, in this embodiment, comprises two parallel linear raised dimples formed on the upper surface of the flange. Grip feature 20 is intended to facilitate a fingertip, fingernail, thumbnail or the like gripping the flange portion 10 and exerting a (downward) force to peel off the lower package 2 from the upper package 4, to allow access to the contact lens 16.

The upper package 4 in this example is shown without a contact lens, but a lens could be contained in the cup-shaped portion thereof. A metallic foil lid 22 is applied to the top of the upper package, so that any lens and aqueous liquid contained in the cup-shaped portion 6 of upper package 4 would remain sterile. In FIG. 1A the foil 22 obscures the details of the package 4, and these are indicated by broken lines.

Example 2

Figure 2A:
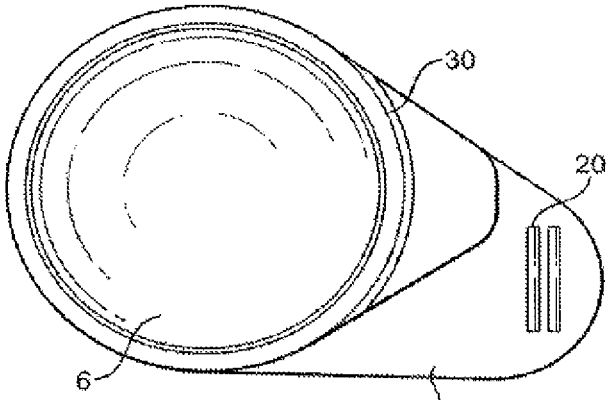
FIGS. 2A and 2B are plan views from above and below respectively of a single package of the same embodiment illustrated in FIGS. 1A-1C.
Figure 2B:
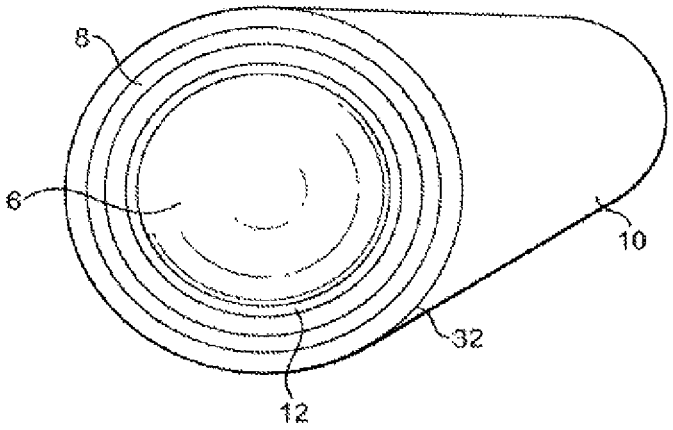

With reference to FIGS. 2A & 2B, this example describes in greater detail the application of adhesive to the adjacent packages.

FIG. 2A shows a plan view looking down onto the upper surface of a package, identical to the embodiment illustrated in FIGS. 1A-1C. FIG. 2B is a plan view of the underside of the package. Parts equivalent to those in FIGS. 1A-1C are denoted by common reference numerals.

As explained elsewhere, the choice of adhesive may be determined at least in part by the choice of material used to form the packages. However, in a preferred embodiment, one side of the package will be formed (typically, moulded) so as to have a relatively rough surface. The other side of the package will be formed so as to have a relatively smooth surface. The adhesive composition will adhere preferentially to the relatively rough surface.

With reference to FIG. 2A, an annular part 30 on the upper surface of the peripheral portion 8 is formed with a relatively smooth surface. In contrast, the equivalently positioned annular or circumferential part 32 on the underside of the peripheral portion 8 is formed with a relatively rough surface.

Accordingly, when the package is peeled away from an overlying stack of equivalent packages, the adhesive tends to remain on the rough surface of the underside of the overlying package, rather than peeling away with the separate package. This reduces the risk of flakes or particles of adhesive falling into the cup-shaped portion 6 of the separated package, where the flakes or particles of adhesive might subsequently be inadvertently introduced into the eye of the contact lens wearer.

The location of the adhesive, and the design of the packages, is further explained with reference to FIG. 3, which shows to a different scale, a detail of part of the sectional view of FIG. 1C.

Figure 3:
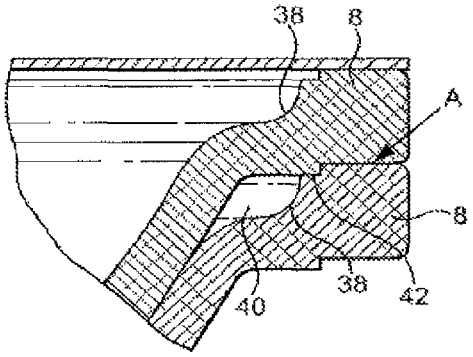
FIG. 3 is a detail of part of FIG. 1C on a different scale.

Referring to FIG. 3, part of the peripheral portion 8 of two stacked contact lens packages is shown. Adhesive (and any prior application of primer, if required) is applied to the part of the peripheral portion indicated generally by the arrow 'A' where the two packages come into contact. The inner/upper surface of the packages, at the interface of the cup-shaped portion 6 and the peripheral portion 8, is formed with an indented curve 38. This localised lack of congruence between the respective profiles creates a small annular cavity 40 between the two packages. The cavity 40 is able to accommodate overflow of any excess adhesive applied to the area A and thus prevent the excess adhesive from contaminating the main cavity 14 in which the contact lens is received. As described above, the underside of the peripheral portion 8 is relatively rough, whilst the upper surface of the peripheral portion 8 is relatively smooth, so that the adhesive adheres to the rough underside when the lower package is removed from the stack.

Another feature is the step 42 in the profile of the peripheral portion, which also helps restrict the application of adhesive to the desired area, by providing a discontinuity in the profile. If desired, step 42 could be made an upward step, with a corresponding recess in the underside of the overlying package. This would improve the ability of the step to prevent the ingress of adhesive, but would be more complicated to mould.

Figure 4A:
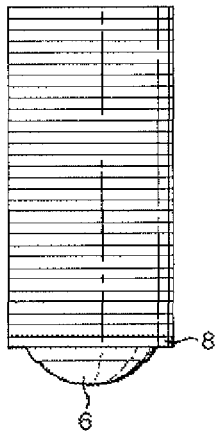
FIGS. 4A-4C show end, perspective and side views respectively of a stack of 30 of the individual packages shown in FIGS. 1 & 2.
Figure 4B:
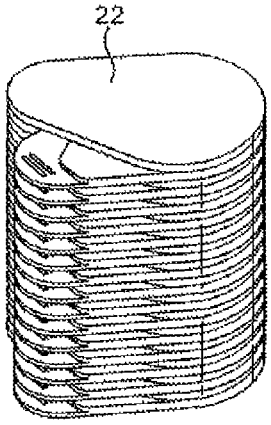
Figure 4C:
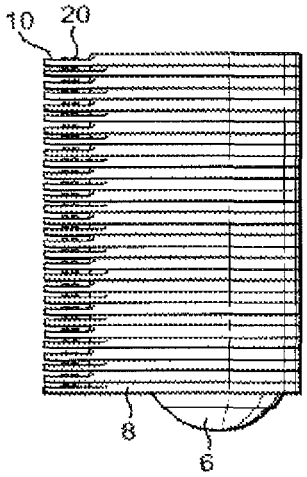

FIGS. 4A-4C show one embodiment of a stack of 30 individually separable contact lens packages, the packages being identical to the embodiment illustrated in FIGS. 1A-1C.

The stack contains alternating left and right handed packages, such that there is a small gap between adjacent left handed packages and adjacent right handed packages, which facilitates the insertion of a fingernail or thumbnail between the partially overlapping flange portions. The upper most package is covered with a lid of conventional metallic foil.

The stack is remarkably compact, being only about 5.37 cm high.

Example 3

Figure 5A:
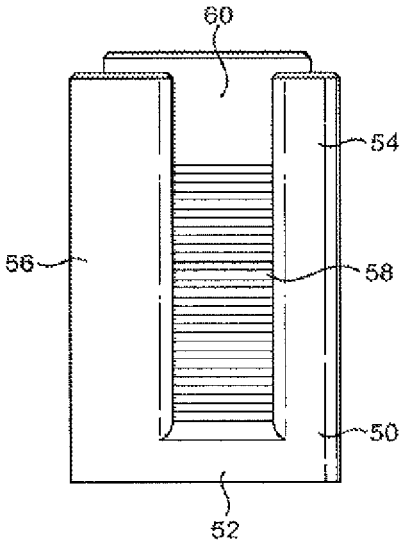
FIGS. 5A-5C are side, perspective and end views of one embodiment of a holder adapted and configured to hold the stack of packages illustrated in FIGS. 4A-C.
Figure 5B:
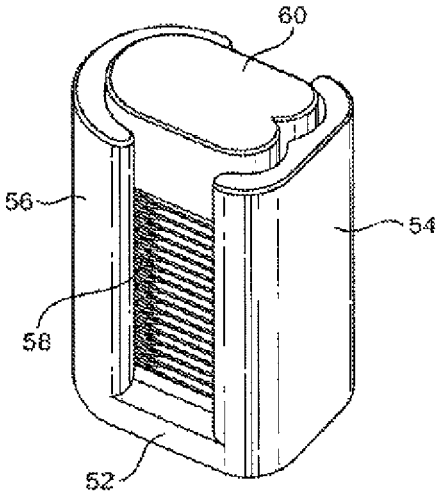
Figure 5C:
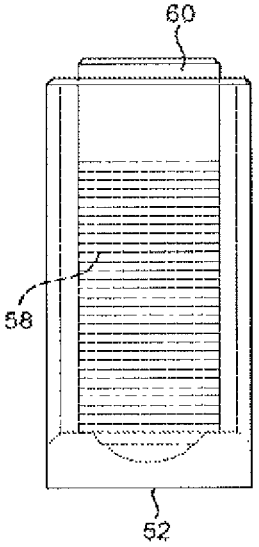

Referring to FIGS. 5A-5C, there is shown a holder for holding a stack of individually separable contact lens packages in accordance with the invention. More especially the holder is adapted and configured to hold a stack of the sort illustrated in FIGS. 4A-C.

The holder 50 is formed from a mouldable synthetic plastics material and comprises a flat, essentially horizontal base, 52, integrally formed with curved front and back upright members 54, 56 respectively. The upright members 54, 56 define between them a substantially vertical channel or groove within which the stack 58 of contact lens packages is accommodated. The inner face of the front upright member 54 is formed with two shallow indentations to accept the projecting flange portions of the left and right handed packages. The holder is also provided with an optional lid 60, which is slidably received within the same channel or groove which accommodates the stack of packages 58, the profile of the lid 60 being suitably shaped and dimensioned.

The holder can be used to hold the stack of contact lens packages upright e.g. on a shelf.

Figure 6A:
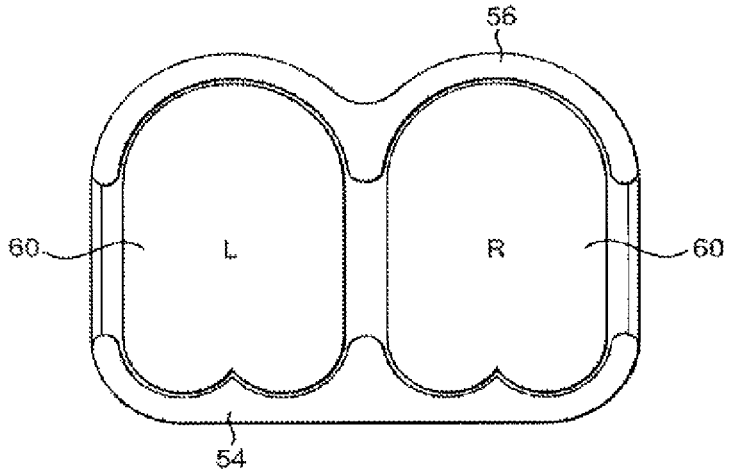
FIGS. 6A and 6B are top plan and perspective views of a second embodiment of a holder, adapted and configured to hold two of the stacks of packages illustrated in FIGS. 4A-C.

FIGS. 6A & B illustrate a slightly different embodiment, the holder being generally as shown in FIGS. 5A-C, but in this instance the front and rear upright members 54, 56 define two grooves or channels, each of which is able to accommodate a stack of contact lens packages, so that two stacks can be held substantially side by side. This embodiment is especially useful for holding two stacks, where one stack of packages contains contact lenses prescribed for a user's left eye and the other stack of packages contains contact lenses prescribed for the user's right eye.

The holder has two removable lids 60, one marked L, and the other marked R. Conveniently the lids will have a handedness or be dissimilar in some way, such that the 'L' lid can only be received in the left hand groove or channel, and the 'R' lid can only be received in the right hand groove or channel.

Figure 6B:
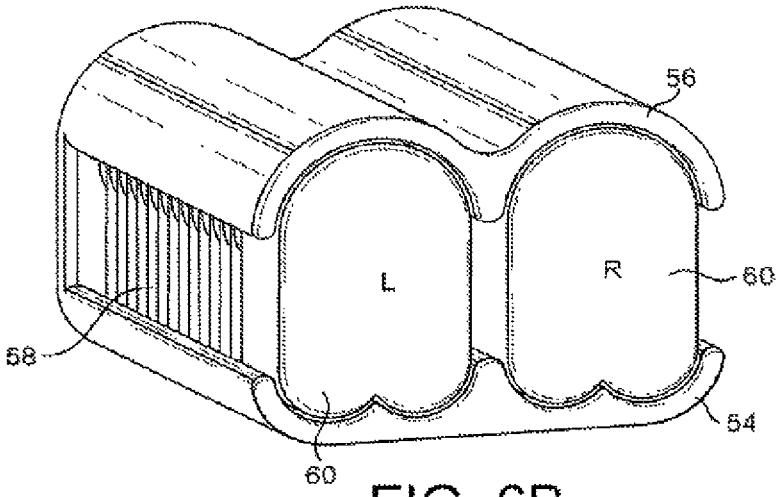
Figure 7A:
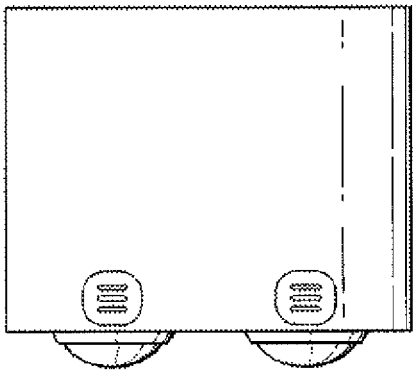
FIGS. 7A-7D are various views of a third embodiment of a holder, comprising dispensing means.
Figure 7B:
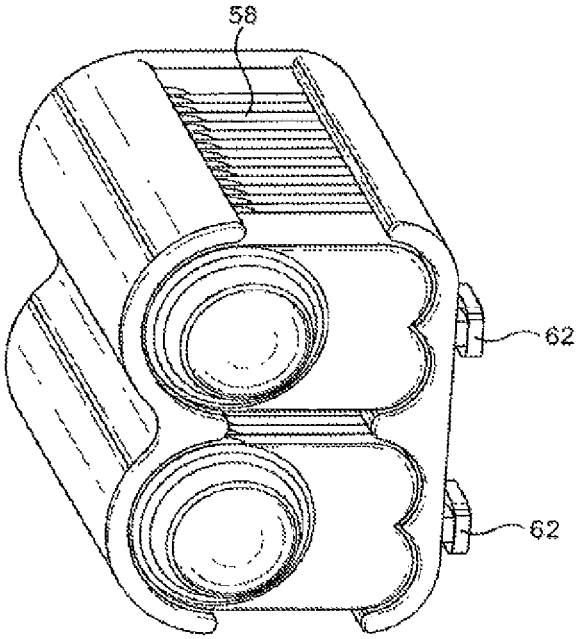
Figure 7C:
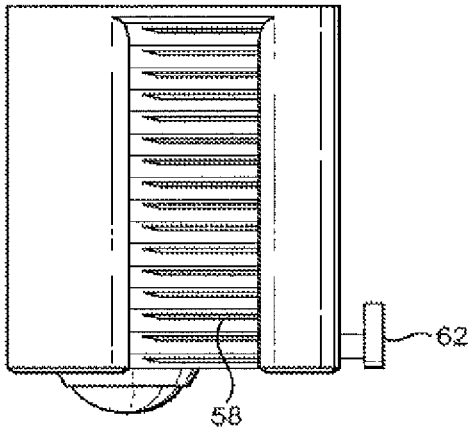
Figure 7D:
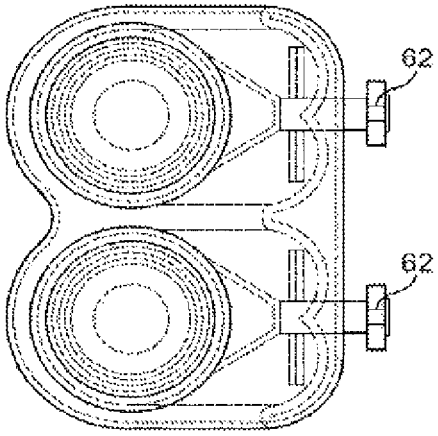

Yet a further embodiment of holder is illustrated in FIGS. 7A-7D. This shows a 'dispenser' type holder. The dispenser is generally similar to the embodiment illustrated in FIG. 6, accommodating two stacks 58 of contact lens packages. However, the holder is additionally provided with two, sprung (or otherwise biased) dispensing buttons 62. When pressed inwards, the dispensing buttons act to force the lower most contact lens package away from the stack. If desired, spring—or other biasing means may be provided in the top of the holder, acting to urge the stack of contact lens packages downwards. Conveniently the dispensing button 62 also acts as a restraining means, acting against the biasing means, and actuation of the button not only separates a package but also temporarily disables the retaining means, allowing the separated package to be urged out of the holder.

Example 4

This example relates to an alternative arrangement of contact lens packages in a stack, as illustrated in FIGS. 8A-C.

In this embodiment, the individual packages are generally as shown in FIG. 1. However, the packages are all identical in shape and do not exist in left- or right-handed forms.

Instead, the individual packages are formed into a stack in which the projecting flange portions 10 are arranged so as to process in a manner rotating around the stack. In the embodiment shown, each flange portion is marked with a day of the week, the packaged lenses being intended for daily wear and subsequent disposal. The stack is arranged so as have rotational symmetry of order 7, such that the contact lens packages corresponding to a particular day of the week occupy the same relative rotational position within the stack.

(Note that FIG. 8C is drawn to a different scale relative to FIGS. 8A & 8B).

Example 5

This example describes one embodiment of a method by which a stack of individual contact lens packages may be formed.

In this embodiment the contact lens packages are moulded from polypropylene, and are in left- and right-handed form. The process of forming the stack, which is automated, is illustrated schematically in FIG. 9.

Referring to FIG. 9, hoppers of pre-formed packages (or "blisters") feed into an automated production line. In step 80, a suitable UV-fluorescent primer composition (e.g. such as Loctite® 770 or 7701) is applied to the desired parts of the peripheral portions of the packages.

The packages are then illuminated with ultraviolet light to cause the primer composition to fluoresce. The fluorescence is monitored by human operatives and/or by cameras (step 82) to check that sufficient primer composition coverage has been achieved. The purpose of the primer is to facilitate 'wetting' of the polypropylene packages with the adhesive.

The contact lenses are then inserted into the concave cup-shaped portions of the packages (84), and a small volume of suitable aqueous liquid (e.g. saline solution) added (86). This is the preferred order of addition of lens and solution, but in principle the order of addition could be reversed, or both lens and solution could be added substantially simultaneously.

Next, a cyanoacrylate adhesive (such as Loctite® 406 or 4061) is applied to the primer-coated parts of the peripheral portion of the packages and the desired number (e.g. 30 or 60) of packages are superimposed to form a stack (steps 88 and 90), such that the stack is formed from the bottom upwards.

Once the adhesive has hardened and the stack is sufficiently stable, the last step (92) is the sterilisation of the stack and the packaged contact lens, in this instance by means of autoclaving.

Example 6

This example relates to an alternative method of forming a stack of individual contact lens packages in accordance with the invention. The method is illustrated schematically in FIG. 10. The method is generally similar to that of the preceding Example as illustrated in FIG. 9, and common reference numerals are used to indicate corresponding method steps.

Thus steps 80-88 in FIG. 10 essentially correspond to steps 80-88 of FIG. 9 and Example 5. In this example however UV light is used to irradiate and sterilise at least the uppermost package and the contact lens and solution therein (step 94), before adding a further package to the top of the stack and repeating the UV sterilisation.

Since UV radiation is not very penetrating, each package must be exposed to the UV (e.g. whilst it is at the top of the stack), before it is covered by another package. The UV light may be continuously on during the process, such that an uppermost package, contact lens, and solution will be exposed to a suitable amount of UV energy, or the UV light may be pulsed, coming on each time a new package and lens etc. is added to the top of the stack. Pulsing of the UV light is generally preferred.

If the stack is completed, the process follows path 96, which terminates the stack formation (e.g. by adding a conventional metallic foil to the uppermost package after it has been UV sterilised). If however one or more further contact lens-containing packages are to be added to the stack, the process follows iterative loop steps 98, 90 and 94 until the stack is completed.

The use of UV irradiation for sterilisation may be especially convenient when, as in the present example, UV exposure is also used to monitor or inspect the amount of coverage of a primer composition comprising a substance which fluoresces under UV illumination. Additionally, or alternatively, UV irradiation may be employed to cause or aid curing of a UV-curable adhesive used to join adjacent packages together. Thus in a preferred embodiment UV irradiation is used both to (a) sterilise the packages and their contents; and (b) (i) cure a UV-curable resin or adhesive which joins adjacent packages; and/or (b) (ii) monitor or inspect coverage of a primer or adhesive composition which fluoresces under UV illumination.

Example 7

This example relates to a further embodiment of packages for use in the invention. In this embodiment the packages are joined by a mechanical sealing fit, which dispenses with the need for an adhesive to form a seal between adjacent packages. The embodiment is illustrated in FIGS. 11A & 11B.

Referring to FIG. 11A, the illustrated embodiment is generally very similar to that shown in FIG. 1, and like parts are denoted by common reference numerals. Thus, for example, FIG. 11A, which is a sectional view, shows two packages 2, 4 of essentially similar size and shape, each with a concave cup-shaped portion 6 and a peripheral portion 8, the latter being provided with a protruding flange section 10. A step 12 is formed in the outer/lower surface of the cup portion 6. A cavity 14 is formed between the two packages.

Relative to FIG. 1C, the packaged contact lens, and the metallic foil on top of the upper package 4, have been omitted from FIG. 11A for clarity.

The two packages 2, 4 are joined together, without the use of any adhesive, by means of a mechanical sealing fit, in this instance a snap fit closure, formed by co-operating profiles. This is best seen in FIG. 11B, which is a detailed view of that part of FIG. 11A indicated by the broken circle.

Referring to FIG. 11B, the upper part of the peripheral portion 8 of the lower package 2 is formed with a small lip 100 around the circumference which projects inwards towards the cavity of the cup-shaped portion 6. The lower part of the peripheral portion 8 of the lower package 2 is provided with a similar circumferential lip 102 which projects outwards. Identical upper and lower lips 100, 102 respectively are formed on the corresponding portions of the upper package 4. The lips at least are formed of a material having slight deformable resilience. Accordingly, when upper package 4 and lower package 2 are pressed relatively towards each other, the lips 100, 102 deform past each other and spring back to clip into the correspondingly-shaped recess on the other package, forming a reciprocal, snug snap-fit closure which sealingly joins together the two packages. Identically-shaped packages can be added to the stack, clipping together in like fashion.

A preferred embodiment, which is a variant of that described above, is disclosed in FIG. 12, which is an enlarged view of the similar detail shown in FIG. 11B. This embodiment provides a tamper-evident seal between adjacent packages. The embodiment is generally as that described above, and like parts are denoted by common reference numerals.

As before, the peripheral portion 8 of the lower package 2 is formed with an inward projecting lip 100 on its upper surface and outward projecting lip 102 on its lower surface. Identically-shaped inward and outward projecting lips 100 and 102 are formed on the peripheral portion of the upper package 4.

The upper lip 100 is formed with a V-shaped notch 104, which constitutes a weakening in the lip. Thus, when the packages 2, 4 are pressed towards each other, the upper lip 100 is able to slide up the gently profiled face of lower lip 102 of the upper package, and clips into the suitably sized and shaped rectangular channel section recess (labelled as 106 on the lower package 2 for clarity). However, attempting to separate the packages forces the upper lip 100 out of the channel, which snaps off and breaks the lip around the zone of weakness created by the notch 104, preventing the packages from clipping back together, thereby creating a tamper-evident seal between the packages.

Yet another embodiment is illustrated in FIGS. 13A and 13B. FIG. 13B is a detailed view, on a different scale, of the part of FIG. 13A indicated by a broken circle.

The embodiment shown in FIG. 13A is similar to that indicated in FIG. 12, and like parts are denoted by common reference numerals. Thus, as with the preceding embodiment, and as best seen in FIG. 13B, the peripheral portion 8 of the lower package 2 is formed with an inward projecting lip 100 on its upper surface and an outward projecting lip 102 on its lower surface. Identically-shaped inward and outward projecting lips 100 and 102 are formed on the peripheral portion 8 of the upper package 4. The packages 2, 4 are thus able to form a reciprocal snap fit closure with one another and a respective reciprocal snap fit with identical packages above and below in the stack.

Again, as in the embodiment illustrated in FIG. 12, the upper lip 100 of the packages is formed with a cut-out or notch 104, creating a weakening in the lip. Accordingly there is a frangible portion (the extreme of the lip 100) which is broken when packages 2 & 4 are separated, such that a tamper-evident seal is formed between packages 2 & 4 once they are joined.

A further difference exists between the embodiment illustrated in FIG. 13A (with the tamper-evident seal) and the embodiment illustrated in FIG. 11. In the embodiment shown in FIG. 11, there is a projecting shoulder 12 formed on the profile of the convex outer surface of the cup-shaped portion, which renders the inner and outer profiles non-congruent, ensuring that a cavity 14 is formed between adjacent packages. In the embodiment shown in FIG. 13, there is no shoulder on the convex profile of the cup-shaped portion. Instead, the inner surface of the cup-shaped portion is "scooped out" relative to the outer surface (e.g. the inner surface has a smaller radius of curvature) so as to confer non-congruency and thereby create a cavity 14 between the adjacent packages.

It will be further noted that the subsidiary cavity 40, which serves to accommodate excess adhesive (if used), has a different shape relative to that shown in FIGS. 11B and 12, as a result of the altered profiles of the packages.

The invention claimed is:

1. A plurality of pre-formed contact lenses provided in a single stack of individually separable, sealed packages, each individual lens being packaged between a first surface and a second surface, wherein the first surface is provided by a first one of the individually separable packages and the second surface is provided by a second one of the individually separable packages, and wherein each package comprises: a concave cup-shaped portion which accommodates a contact lens and an aqueous liquid; and a peripheral portion; the packages being stacked such that the concave cup-shaped portion of one package is partially accommodated within the concave cup-shaped portion of an adjacent package, thereby reducing dead volume in the stack.

2. A stack according to claim 1, wherein each of the plurality of packages is essentially identical.

3. A stack according to claim 1, comprising a plurality of left-handed packages and a plurality of right-handed packages, the handedness optionally being conferred by the shape or position of a projecting flange portion.

4. A stack according to claim 1, wherein the peripheral portion comprises a thin protruding flange portion, which projects outwardly and provides a surface to which a consumer may apply a suitable force to separate an individual package from the stack.

5. A stack according to claim 1, wherein adjacent members of the stack are sealed to one another by means of an adhesive.

6. A stack according to claim 1, wherein adjacent members of the stack are sealed to one another by a mechanical sealing fit.

7. A stack according to claim 6, wherein the packages comprise a frangible portion which is broken or ruptured if adjacent packages are separated, such that a tamper-evident seal is provided.

8. A stack according to claim 1, in combination with a holder, said holder having a flat base portion and at least one upright member which defines a channel or groove which accommodates the stack.

9. A stack and holder combination according to claim 8, wherein the upright member and flat base portion are integrally formed from a synthetic plastics material.

10. A stack and holder combination according to claim 8, wherein the channel or groove accommodates two stacks of contact lens packages, side-by-side.

11. A stack and holder combination according to claim 8, wherein the holder comprises dispensing means, actuation of which serves to separate an individual contact lens package from the stack.

12. A stack and holder combination according to claim 8, wherein the holder comprises biasing means which tends to urge the stack out of the holder, and restraining means which resists the biasing means.

13. The stack according to claim 1, wherein the contact lenses are sterile and ready to wear.

* * * * *